US006109974A

United States Patent [19]

Kodaira

[11] Patent Number: 6,109,974

[45] **Date of Patent: *Aug. 29, 2000**

[54] ELECTRICAL CONNECTOR

[75] Inventor: Yoshihiko Kodaira, Tokyo, Japan

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 09/084,658

[22] Filed: May 26, 1998

[30] Foreign Application Priority Data

Jun. 11, 1997 [JP] Japan ..... 9-004949

[51] Int. Cl.[7] ..... H01R 13/10; H01R 33/00

[52] U.S. Cl. ..... 439/682; 439/857

[58] Field of Search ..... 439/856, 857, 439/733.1, 682, 686, 689

[56] References Cited

U.S. PATENT DOCUMENTS

| | | | |
|---|---|---|---|
| 2,683,259 | 7/1954 | Lowther . | |
| 2,779,011 | 1/1957 | Deakin . | |
| 3,865,462 | 2/1975 | Cobaugh | 439/682 |
| 4,175,821 | 11/1979 | Hunter . | |
| 4,241,970 | 12/1980 | Rider elt al. . | |
| 4,781,612 | 11/1988 | Thrush . | |
| 4,795,379 | 1/1989 | Sasaki | 439/856 |
| 5,183,421 | 2/1993 | Yin . | |
| 5,252,097 | 10/1993 | Lindeberg | 439/856 |
| 5,409,406 | 4/1995 | McClure . | |

FOREIGN PATENT DOCUMENTS 0 777 306 A1 6/1997 European Pat. Off. .

*Primary Examiner*—Lincoln Donovan
*Assistant Examiner*—Javaid Nasri
*Attorney, Agent, or Firm*—Perman & Green, LLP

[57] ABSTRACT

An electrical connector including a female connector (40). The female connector (40) is provided with a housing (12) which have insertion slots (14) opening its one side and allowing male terminals (6) to be inserted, and a plurality of female terminals (10) each having a pair of contact sections (46) which project into the respective insertion slots and hold a male terminal from both of its sides, and having a base section (42) which support these contact sections via a pair of arm sections and is fixed onto the housing. The housing (12) has a recess portion (22) which receives the base section (42) and is formed on one of side wall portions 20 partitioning the insertion slot (14). The arm sections (44) extend from the base section (42) received in the recess portion (22) in a state of being inclined with respect to the axial line of the insertion slot (14). The contact sections (46) are situated on the intermediate position between the side wall portion (20) having the recess portion (22) and the opposed side wall portion.

18 Claims, 5 Drawing Sheets

ELECTRICAL CONNECTOR

BACKGROUND OF THE INVENTION

1. Field of the Invention

The present invention relates to An electrical connector for electrically, and mechanically connecting an electronic apparatus such as a hard disk drive to a printed circuit board.

2. Brief Description of Prior Developments

With the miniaturization and densification of an electronic apparatus such as a notebook type or palmtop type personal computer, there has been required the miniaturization of a electrical connector to be mounted on a printed circuit board.

In general, some of such miniaturized electrical connectors have female terminal, for electrically connecting to pin-like male terminals, being formed flat by a conductive plate member. In the female terminals, a pair of contacts portions opposed in a plane at a predetermined space are supported by a plate-like base portion through a pair of arm portions. When a male terminal is fitted in between the paired contact sections of the female terminal, the arm sections are pressed by means of the male terminal, and then, move along a surface of the plate member. Whereupon the arm portions urges the paired contact portions toward a pin-like male terminal with a spring force generated by the movement of arm portions. Even if a thickness of the arm section is thin, a great spring force is created in the arm sections, so that the female terminal and the male terminal can be mechanically and electrically connected to each other. However, in the case where there is a need of making longer the male terminal and inserting it into the innermost position of the female terminal, a distal end portion of the male terminal abuts against the base portion. For this reason, the arm section is required to be formed longer. In this case, the electrical connector is made large in its dimension.

SUMMARY OF THE INVENTION

In order to solve the above problems, it is an object of the present device is to provide a electrical connector which can insert a longer male terminal into the innermost position of a female terminal without making large a dimension of the electrical connector. To achieve the above-mentioned object of the present device, there is provided an electrical connector comprising:

a housing made of an insulating-material, having a plurality of insertion slots which receive male terminals and open in one side of the housing; and a plurality of female terminals each having a pair of contact sections which project into the insertion slot and hold the male terminal from its both side so as to be electrically connected with the male terminal, and having a base section which supports these contact sections via a pair of arm sections and is fixed onto the housing, the housing having a retaining portion which is a recess portion formed on one of side wall portions partitioning the insertion slot so as to receive the base section, the arm sections of the female terminal extending from the base section received in the retaining portion in a state of being inclined with respect to the axial line of the insertion slot, the contact sections being situated on an intermediate position between the side wall portion formed with the recess portion of being the retaining portion and the opposed side wall portion. In the aforesaid electrical connector, the paired contact sections of the female terminal project into the insertion slot while the base section thereof being received on the retaining portion which is the recess portion formed on one of side wall portions partitioning the insertion slot. Thus, the male terminal inserted into the insertion slot can be electrically and mechanically connected with the paired contact sections. Also, the male terminal does not abut against the base section of the female terminal even if being inserted into the innermost position thereof. With the above construction, a longer male terminal is inserted by the innermost position between the female terminals, so that an electrical and mechanical connection can be securely made without making large a dimension of the female terminal and the housing of the electrical connector. The housing may have guide grooves which are individually formed on the mutually opposed side wall portions on both sides of the side wall portion formed with the recess portion of being the retaining portion so as to receive the arm sections. Thus, the arm sections of the female terminal slide in the guide grooves, so that a spring effect of the arm sections can be securely exhibited. Moreover, the housing may have slots which have one end opening in the retaining portion and extend toward one side of the housing where the insertion slot is open along the axial line of the insertion slot in the side wall portion formed with the recess portion of being the retaining portion. And also, the female terminal may have the middle tongue section which extends from the base section between the arm sections. Thus, when the base section of the female terminal is received in the retaining portion of the housing, the middle tongue section is fitted into the slots of the housing. Therefore, a rotational force acts on the base section when an insertion force of the male terminal is applied to the contact sections; however, the rotational force is offset by the middle tongue section. With the middle tongue section being formed with a plurality of small projections at its periphery, these small projections bite into the housing material so that the female terminal can be firmly held in the housing. Further, according to the present invention, there is provided a housing for an electrical connector, which is made of an insulating-material, has a plurality of insertion slots receiving male terminals and opening in its one side, and receives a plurality of female terminals each having a pair of contact sections which project into the insertion slot and hold the male terminal from its both side so as to be electrically connected with the male terminal, and having a base section which supports these contact sections via a pair of arm sections and is fixed onto the housing, the housing having a retaining portion which is a recess portion formed on one of side wall portions partitioning the insertion slot so as to receive the base section, slots which have one end opening in the retaining portion and extend toward one side of the housing where the insertion slot is open along the axial line of the insertion slot in the side wall portion formed with the recess portion of being the retaining portion, and guide grooves which are individually formed in mutually opposed side wall portions on both side of the side wall portion formed with the recess portion of being the retaining portion and receive the arm sections, the slots holding the middle tongue section extending from the base section between the paired arm sections of the female terminal, the guide grooves guiding the arm sections of the female terminal from the base section received in the retaining portion into a direction of being inclined with respect to the axial line of the insertion slot, the contact sections of the female terminal being situated on an intermediate position between the side wall portion formed with the recess portion of being the retaining portion and the opposed side wall portion, and being slidable in the guide grooves along directions closing to and away from the axial line of the insertion slot. Furthermore, according to the present invention, there is provided a female terminal for a thin plate like electrical connector, which is received in an insulating-material housing having a plurality of insertion slots receiving a male terminal and opening in its one side, and which has a pair of contact sections which project into the insertion slot and hold the male terminal from its both side so as to be electrically connected with the male terminal, and a base section which supports these contact sections via a pair of arm sections and is fixed onto the housing, the female terminal including a middle tongue section extending from the base section between the paired arm sections and a plurality of small projections projecting from the periphery of the middle tongue section, the arm sections extending from the base section in a state of being inclined with respect to a thickness direction so that the contact sections are situated on a position offset in the thickness direction from the base section, the middle tongue section, when the base section is received in a retaining portion which is a recess portion formed on one of side wall portions partitioning the insertion slot of the housing, being inserted into a slot which has one end opening in the retaining portion and extend toward one side of the housing where the insertion slot is open along the axial line of the insertion slot in the side wall portion formed with the recess portion of being the retaining portion, the arm sections being guided so as to be slidable in guide grooves individually formed in mutually opposed side wall portions on both side of the side wall portion formed with the recess portion of being the retaining portion, the contact sections being arranged on an intermediate position between the side wall portion formed with the recess portion of being the retaining portion and the opposed side wall portion, thereby the contact sections producing a spring force in directions closing to and away from the axial line of the insertion slot.

DETAILED DESCRIPTION OF THE EMBODIMENT

Figure 1A:
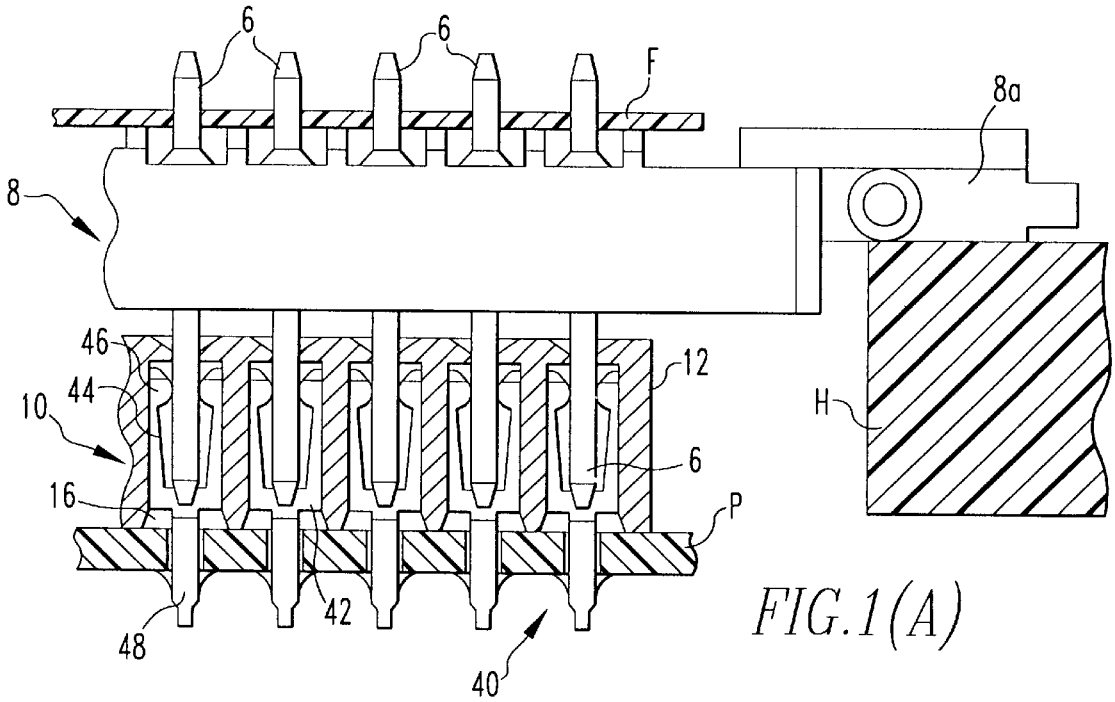
FIGS. 1(A) and 1(B) illustrate explanatory views showing an inner structure of a female connector according to a preferred embodiment of the present invention at a state of being engaged with a male connector, FIG. 1(A) being a diagrammatically longitudinal cross-sectional view, and FIG. 1(B) being a diagrammatically transverse cross-sectional view.

A preferred embodiment of the present device will be explained below in detail with reference to the accompanying drawings. FIG. 1 shows a state in which a male connector 8 is fitted into a female connector 10 in an electrical connector according to a preferred embodiment of the present invention. In this embodiment, the male connector 8 is arranged in a hermetic case of a hard disk drive, and is secured by threads onto the hard disk drive via a fixing portion 8*a* thereof. is connected to end portions of male terminals 6 projecting into the case, and the male connector 8 is electrically connected with internal equipments and electronic apparatuses via the board F. And then, relatively long terminals projecting outwardly on the case are fitted into the female connector 10 so as to be electrically connected with external equipments. A reference P denotes a printed circuit board on which the female connector 10 is mounted.

Figure 1B:
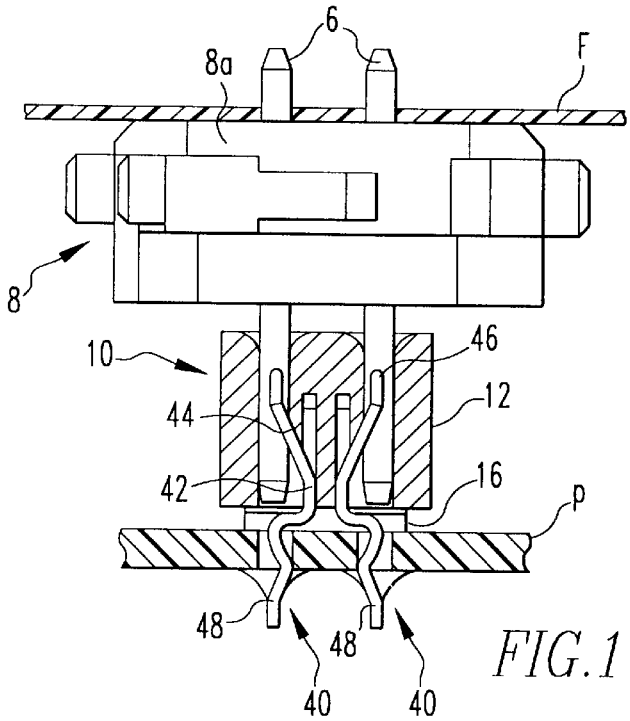
Figure 2A:
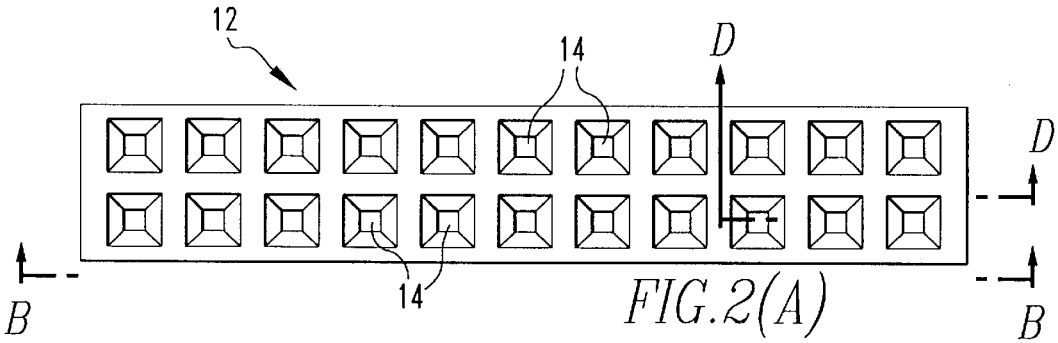
FIGS. 2(A) through 2(D) illustrate explanatory views showing a housing of the female connector in FIG. 1, FIG. 2(A) being a plan view, FIG. 2(B) being a front view as taken along Line B—B in FIG. 2(A), FIG. 2(C) being a cross-sectional view as taken along line C—C in FIG. 2(B), and FIG. 2(D) being a cross-sectional view as taken along line C—C in FIG. 2(A)
Figure 2B:
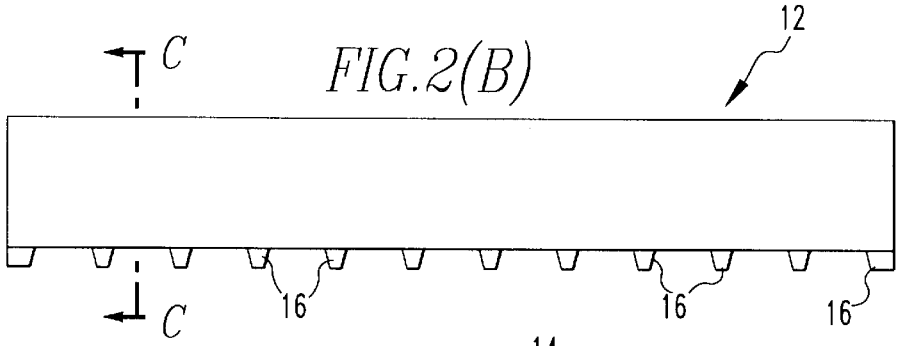

FIG. 2(A) to FIG. 2(D) diagrammatically show plan, front and cross-section views of the female connector 10. A housing 12 of the female connector 10 is formed of an insulating material and is molded into an integral structure. Further, the housing 12 is formed with, e.g., 22 insertion slots 14, each of which receives the male terminal 6, and which are arranged in two lines. As shown in FIG. 2(A), the respective insertion slots 14 are arranged at predetermined intervals, and are open at one side of the housing 12, that is, its upper side into which the male connector 8 is fitted. An opening of the insertion slot 14 is formed slightly larger than the male terminal. Also, wall portions 16 are arranged at predetermined intervals along the longitudinal direction of the housing 12. These wall portions 16 project toward the printed circuit board P (see FIG. 1), and servo as a stand-off. The housing 12 may be formed of a proper insulating material; however, it is preferable to use a PPS (polyphenylene sulfide) resin in order to obtain desired heat resistance, insulating performance and strength.

As shown in FIG. 2(A), each of insertion slots 14 has a square opening at its upper side with which the male connector 8 is connected.

Figure 2C:
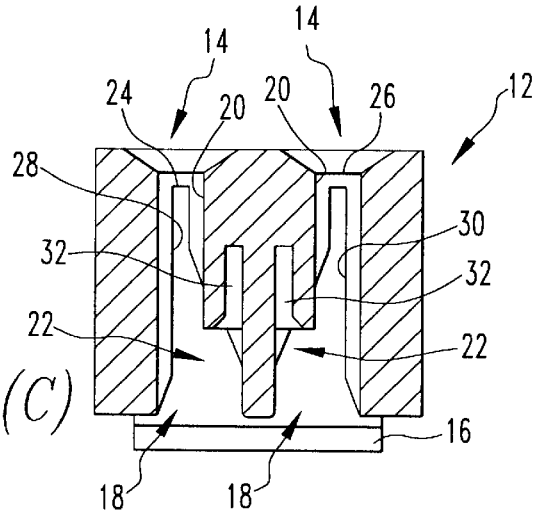
Figure 2D:
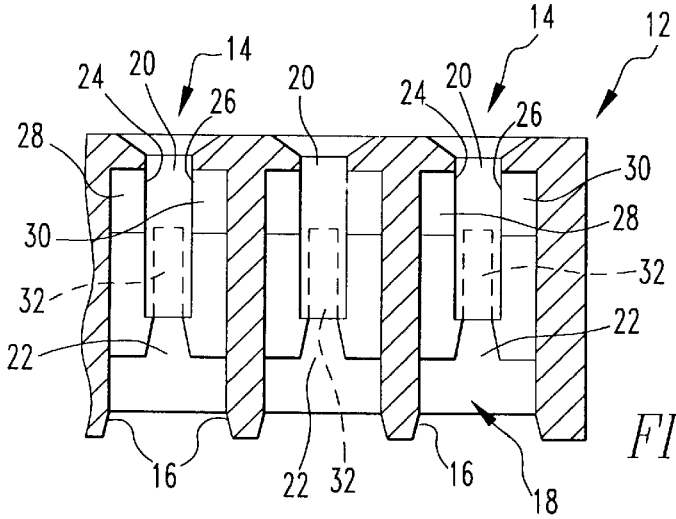

An edge portion of the insertion slot 14 is formed with an inner inclined plane for guiding the male terminal 6 thereto. Also, a lower side of the housing, that is, a side mounted onto the printed circuit board P is formed with an opening 18 for attaching a female terminal which will be described later, and communicates with the insertion slot 14. Each of these insertion slots 14 is partitioned by four side wall portions in the housing 12. A side wall portion 20 which is one of these side wall portions is formed with a recess portion 22. opposed side wall portions 24 and 26 on both sides of the side wall portion 20 having the recess portion 22 are formed with guide grooves 28 and 30 opposing to each other, respectively. A reference numeral 32 denotes a slot formed in the side wall portion 20. The slot 32 extends along the axial line of the insertion slot 14 in the side wall portion 20, and has a lower end portion opening to the recess portion 22. In this embodiment, the side wall portion 20 having the recess portion 22 is arranged inside the housing 12. Therefore, as shown in FIG. 2(C), two insertion slots 14 adjacent to each other in the transverse direction of the housing 12 are symmetrically arranged. The recess portion 22 functions as a retaining section for receiving a base section of a female terminal 40 which will be described later.

Figure 3A:
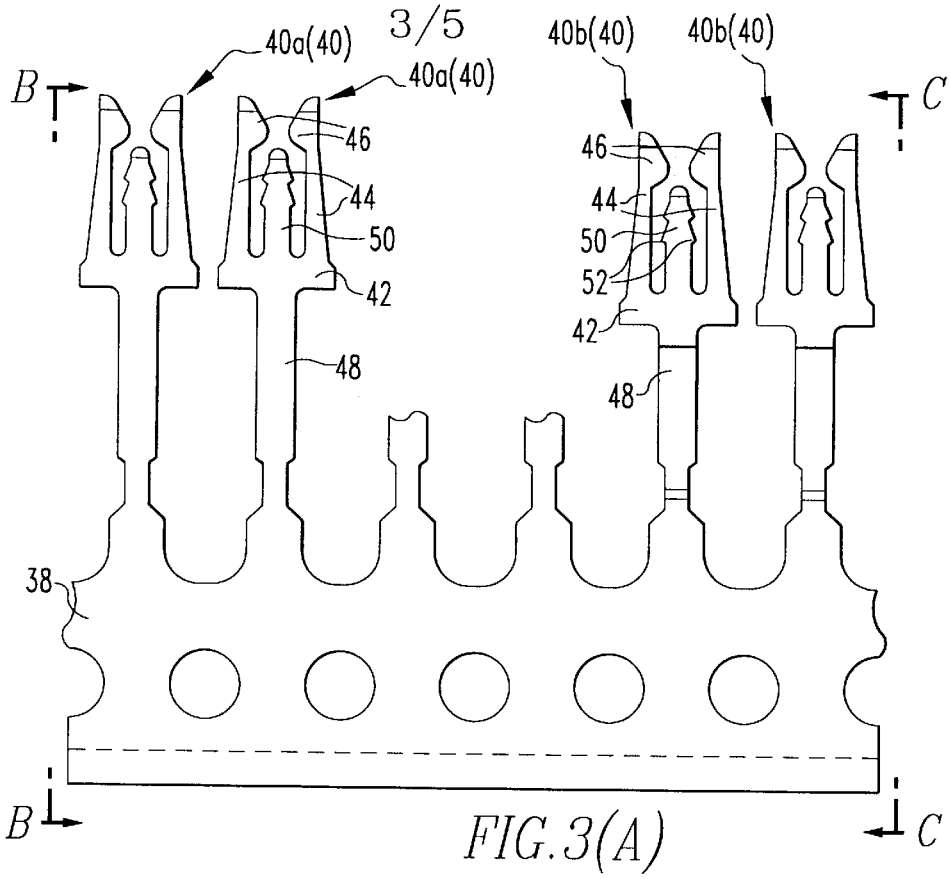
FIGS. 3(A) through 3(C) illustrate explanatory views showing a female terminal according to a preferred embodiment of the present device, FIG. 3(A) being a view showing a state of being punched from a blank and being partly folded, FIG. 3(B) being a view as taken along line B—B in FIG. 3(A), and FIG. 3(C) being a view as taken along C—C in FIG. 3(A)
Figure 3B:
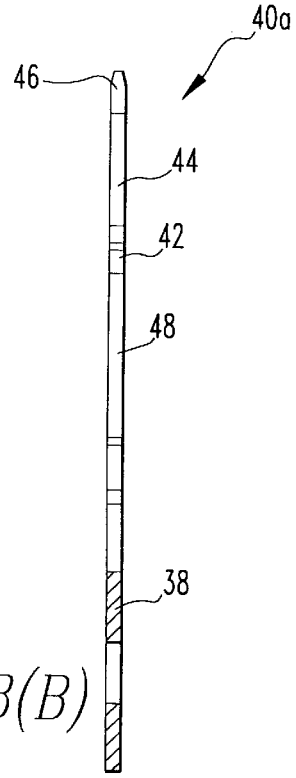
Figure 3C:
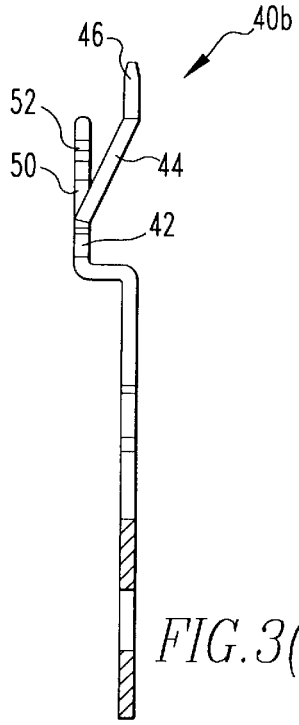

FIG. 3(A) and FIG. 3(B) show female terminals which are inserted into the housing 12 through the opening 18.

As shown in FIG. 3(A), a female terminal 40 of this embodiment is formed by being punched from a blank 38 made of electrically and mechanically preferable metal such as bronze. In the female terminal 40, an inner side portion contacting with the male terminal 6, that is, a contact which will be described later, is subjected to so-called shaving so as to be formed into a flat surface. This serves to prevent the male terminal 6 from being damaged when contacting with the male terminal 6. In a state of being punched from the blank 38, the female terminal 40 has a flat shape as shown by a reference numeral 40*a* in the left-hand side of FIG. 3(A) and FIG. 3(B). Thereafter, principal parts of the female terminal 40*a* are bent so as to be formed into a solid shape as shown by a reference numeral 40*b*. Each of the female terminals 40 has a plate like base section 42, a pair of arm sections 44 extending from the base section, and a contact section 46 provided on the distal end of the respective arm sections 44. Also, a solder tail 48 extends from a lower side of the base section 42, that is, to a side opposite to the arm section 44. At first, the female terminal 40 is supported onto the blank 38 through tail section 48. Moreover, a middle tongue section 50 extends from the base section 42 between the paired arm sections 44, 44. The middle tongue section 50 has a distal end formed into taper, and is formed with a plurality of small projections 52 projecting from its circumferential portion. In this embodiment, the small projection 52 projects along the surface direction on the same plane as the middle tongue section 50. However, the small projection 52 is not limited to this, and may be extended in a thickness direction or in both thickness and surface directions. The female terminal 40 is bent from the flat shape as shown by the reference numeral 40*a* into the solid shape as shown by the reference numeral 40*b*. In such a bent state, the paired arm sections 44 is bent so as to be inclined with respect to the plane where the base section 42 and the middle tongue section 50 are arranged. On the other hand, the contact section 48 is offset in a thickness direction so as to be substantially parallel with the base section 42 and the middle tongue section 50.

Figure 4:
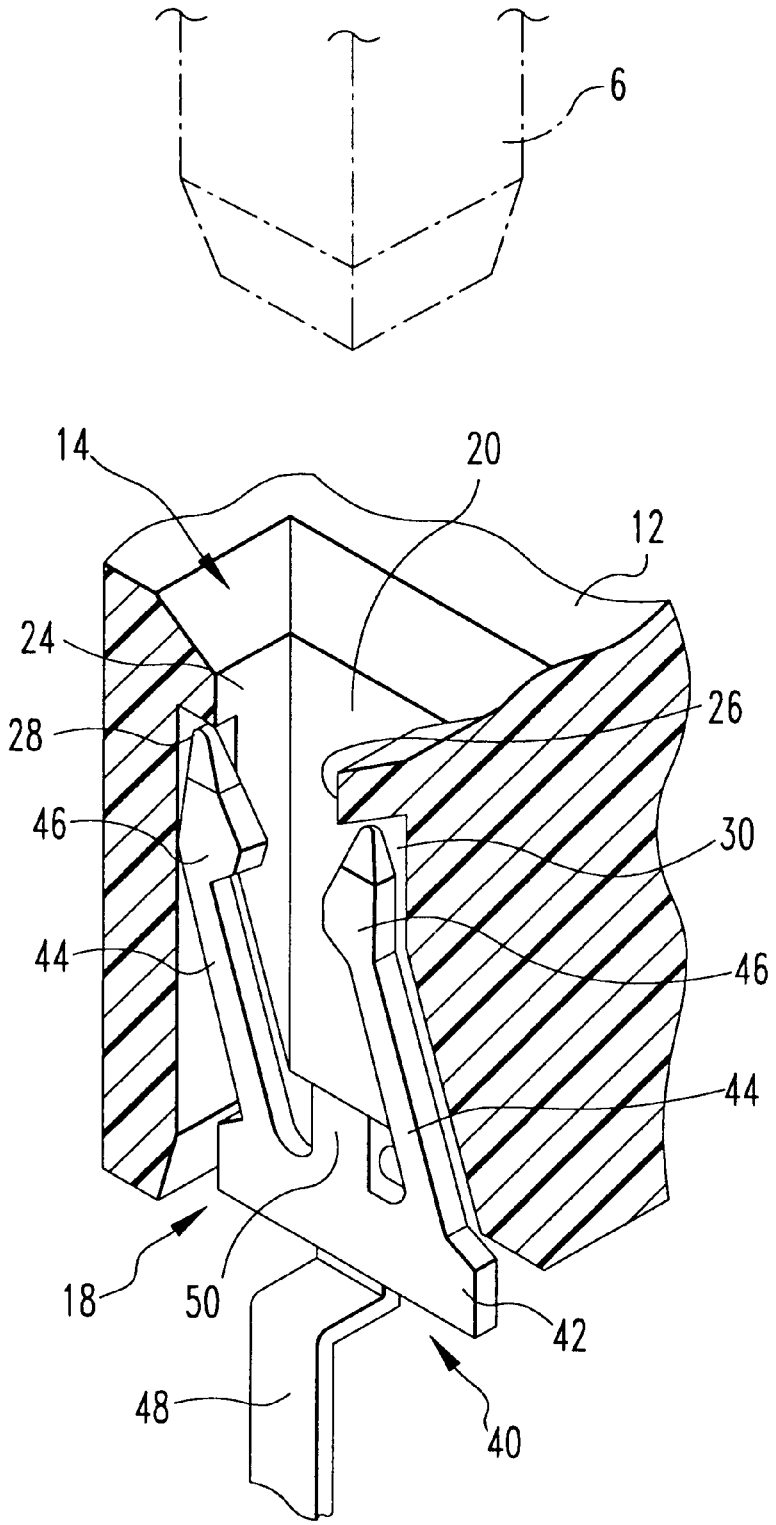
FIG. 4 is a perspective view diagrammatically showing an inner structure of an insertion slot and an arrangement of a female terminal.

FIG. 4 shows a state in which the aforesaid female terminal 40 is fitted into the housing 12. Each of the female terminals 40 is inserted into the housing 12 through the opening 18, and then, the middle tongue section 50 thereof is inserted into the slot 32 (see FIG. 2(C) and (D)) formed in the side wall portion 20. Small projections 52 formed at the periphery of the middle tongue section 50 bite into the housing material to firmly retain the female terminal in the housing 12. When the middle tongue section 50 is inserted into the slot 32, the base section 42 is retained on the recess portion 22 which is formed as a retaining portion of the side wall portion 20. Thus, the female terminal 40 does not project into the insertion slot 14. Also, in the case where the base section 42 is retained on the recess portion 22, both edge portions of the base section may bite into their neighborhood wall portions 24 and 26. By doing this, the female terminal 40 can be more firmly retained. Arm sections 44,44 are individually received in guide grooves 28 and 30 formed in the side wall portions 24 and 26. These arm sections 44,44 extend along the guide groove 28 and 30 from the base section 42 received in the retaining portion, that is, in the recess portion 22, in a state of being inclined with respect to the axial line of the insertion slot 14. Contact sections 46 on the distal end of the arm sections between portion 44 is situated on the intermediate position the side wall portion 20 formed with the recess 22 and the slot 32 and the opposed side wall (see FIG. 1(B)). The respective arm sections 44, 44 are slidable in the guide grooves 28 and 30 along directions in which these contact sections 46 is closed to and away from the axis of the insertion slot 14. ordinarily, these contact portions 46,46 are arranged in a state of projecting into the insertion slot 14. It is possible to form the solder tail section 48 into a proper shape. In case of bending the solder tail section 48 as shown in FIG. 1(B), when the solder tail sections 48 are inserted into a through hole of the printed circuit board P, it is possible to momentarily hold these solder tail sections 48 on the printed circuit board P.

Figure 5A:
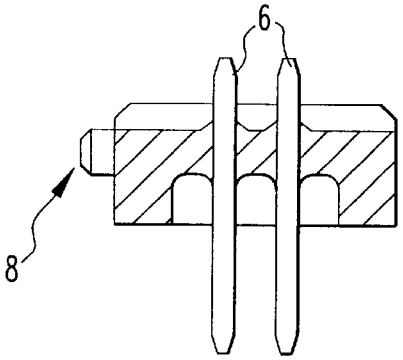
FIGS. 5(A) and 5(B) are explanatory views showing a male connector which is in a state of being engaged with the female connector of FIG. 1, FIG. 5(A) being a transverse cross-sectional view, and FIG. 5(B) being a partly enlarged view.
Figure 5B:
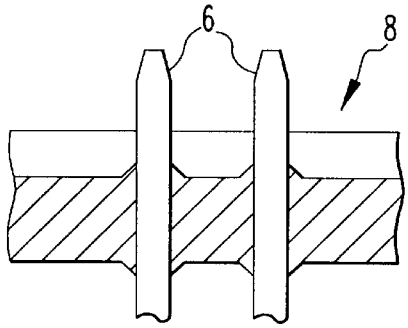

FIG. 5(A) and FIG. 5(B) individually show a cross section of the male connector 8 paring with the female connector 10 as described above. The male connector 8 has 22 male terminals comprising a square-section pins which is the same number as the female terminal 40. Liquid crystal polymer (LCP) is applied onto the circumference of respective male terminals 6 by injection molding. As shown in FIG. 5(B), the male terminal 6 has a small diameter portion for preventing it from coming off at its intermediate portion. Also, the male terminal has a tapered distal end portion. As shown in FIG. 5(C), preferably, a side of the square section of the male terminal has a length of a substantially half of a side of the square section of the insertion slot 14.

It is possible to provide preferable engagement of the aforesaid female connector 10 with the male connector having longer terminals 6. As shown in the right-hand side of FIG. 6(A), normally, the male terminal 6 is inserted coaxially with the axis of the insertion slot 14, and the distal end portion thereof reaches between opposed contact sections 46 and 46. And then, when a distance between contact sections 46 and 46 is widened by means of the inserted male terminal 6, arm sections 44, 44 slide in the guide grooves 28 and 30. When the male terminal i further inserted into the insertion slot 14, the male terminal 6 is pressed from its both side by contact sections 46 and 46 in a state of being held therebetween, so that it is electrically connected with the female terminal 40 while being mechanically connected therewith by a spring force of the arm sections 44, 44. Also, since the base section 42 is retained in the recess portion 22 of the side wall portion 20, the male terminal does not interfere with the base section 42 even if being inserted into the inner part. Therefore, there is no need of making large the dimension of the female terminal 40 and the housing 12 of the female connector 10. Moreover, it is possible to electrically and mechanically connect the male connector 8 with female connector 10 in a state of inserting the longer male terminal 6 by the innermost position of the female terminal. The middle tongue section 50 is inserted into the slot 32 (see FIG. 2(C)). When the male terminal 6 pushes the contact sections 46;46, a rotational force acting on the female terminal 40 is offset by means of the middle tongue section 50; therefore, the female terminal 40 does not come off from the housing 12.

Figure 6A:
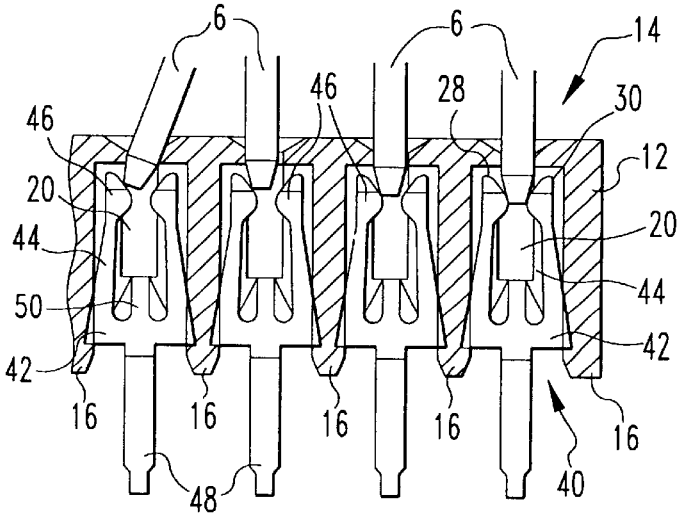
FIGS. 6(A) through 6(C) are explanatory views showing a state in which the male connector is engaged with the female connector according to the preferred embodiment of the present device, FIG. 6(A) being a longitudinal cross sectional view, FIG. 6(B) being a transverse cross sectional view and FIG. 6(C) being a top plan view from C—C in FIG. 6(B).
Figure 6B:
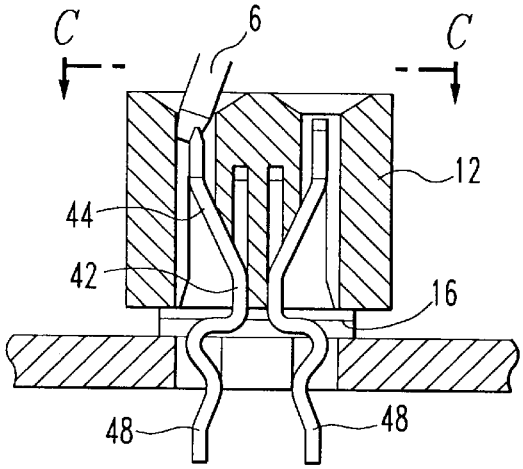
Figure 6C:
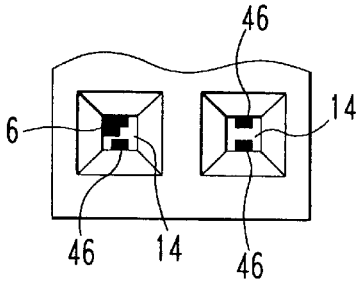

Even if the male terminal 6 is inserted into the insertion slot 14 in a state of being inclined with respect to the axis of the insertion slot 14 as shown in the left-hand side of FIG. 6(A) and FIG. 6(B), the male terminal 6 necessarily contacts with the contact section 46 as shown in FIG. 6(C) because its distal end portion is formed so that a side of the square section of the male terminal has a length of a substantially half of a side of the square section of the insertion slot 14. Thus, it is possible to guide arm sections 44 into guide grooves 28 and 30 via the contact section 46. Therefore, the male or female terminal can be prevented from being damaged due to an engagement of the contact sections 46 and the male terminal 6. According to the aforesaid female connector 10, the longer male terminal can be securely inserted by the innermost position of the female terminal. As is evident from the above explanation, the electrical connector according to the present device is constructed in the following manner. Namely, the base section of the female terminal is received in the retaining portion recessed on one of side wall portions partitioning the insertion slot of the male terminal, and the arm sections supporting the contact sections extend in a state of being inclined with respect to the axial line of the insertion slot. Moreover, since the contact sections are situated on the intermediate position between the side wall portion recessed the retaining portion and the opposed side wall portion, the base section is arranged in a position shifting from the axial line of the insertion slot. Whereby is possible to insert a longer male terminal by the innermost position of the female terminal; therefore, the male terminal and the female terminal can be securely connected to each other. Also, since the housing has guide grooves which receive the arm sections and are individually formed on opposed side wall portions on both side of the side wall portion formed with a recess portion of being the retaining portion, the arm sections of the female terminal slide on the guide grooves, so that the spring effect of arm sections can be securely exhibited. Thus, the male terminal can be securely held by the elastic force. The housing is further formed with slots which have one end opening to the retaining portion and extend toward one side of the housing along the axial line of the insertion slot 14 in the side wall portion it recessing the retaining portion. The female terminal has a middle tongue section extending from the base section between the paired arm sections. When the base section of the female terminal is received in the retaining portion of the housing, the middle tongue section thereof is retained in the slots of the housing. Thus, even if the base section is affected by a rotational force because the pushing force of the male terminal acts on the contact sections, the middle tongue section serves to prevent the rotation of the base section, so that the base section can be securely retained in the retaining portion. The middle tongue section is formed with a plurality of small projections at its periphery. These small projections bite into the housing material so that the female terminal is firmly held in the housing. Thus, the female terminal can be prevented from coming off from the housing.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

a housing comprising at least one male terminal insertion slot, and a recess adjacent to and offset from the insertion slot; and at least one female terminal connected to the housing, the female terminal comprising a base section, arm sections extending from the base section, and male terminal contact sections on the arm sections, wherein the male terminal contact sections are located opposite each other on opposite sides of an axial center line of the insertion slot, and wherein the base section is located in the recess offset from the axial center line of the insertion slot, wherein the female terminal further comprises a mounting tongue extending from the base section inclined relative with the arm sections and from an area between the arm sections, and wherein the mounting tongue is located in a mounting slot of the housing substantially parallel to the male terminal insertion slot.

2. An electrical connector as in claim 1 wherein the housing comprises an opening in a side of the housing which opens directly into the insertion slot and the recess.

3. An electrical connector as in claim 1 wherein the housing further comprises a female contact mounting slot extending from the recess.

4. An electrical connector as in claim 3 wherein the mounting slot extends into a side wall portion of the housing which forms the insertion slot, a portion of the side wall portion separating the mounting slot from the insertion slot.

5. An electrical connector as in claim 4 wherein the mounting slot extends into the side wall portion generally parallel to the insertion slot.

6. An electrical connector as in claim 3 wherein the housing comprises an opening in a side wall of the housing which opens directly into the insertion slot and the recess, and wherein the recess is located between the mounting slot and the opening.

7. An electrical connector as in claim 1 wherein the housing further comprises two guide grooves extending into opposite side wall portions of the housing which form the insertion slot, the recess being adjacent both the guide grooves.

8. An electrical connector as in claim 7 wherein the two guide grooves both include an inclined angled wall between the recess and the insertion slot.

9. An electrical connector as in claim 7 wherein the two guide grooves both comprise an end located proximate an entry into the insertion slot that have longitudinal axes substantially parallel to the axial center line of the insertion slot.

10. An electrical connector as in claim 1 wherein the mounting slot is isolated from the male terminal insertion slot by a portion of the housing.

11. An electrical connector as in claim 1 wherein the male terminal contact sections are located at distal ends of the arm sections and are generally parallel to the axial center line of the insertion slot.

12. An electrical connector as in claim 1 wherein the female terminal further comprises a solder tail extending from the base section coaxial with a receiving area between the male terminal contact sections.

13. An electrical connector comprising:

a housing comprising at least one male terminal insertion slot, a recess adjacent the insertion slot, and a female terminal mounting slot extending from the recess; and at least one female terminal connected to the housing, the female terminal comprising a base, arms extending from the base, male terminal contact sections on the arms, and a mounting section extending from the base, wherein the contact sections are located in the insertion slot on opposite sides of an axial center line of the insertion slot, wherein the mounting section extends in substantially a same direction from the base as the arms, wherein the arms are inclined relative to the mounting section, and wherein the mounting slot and the mounting section are offset from the insertion slot and its axial center line.

14. An electrical connector as in claim 13 wherein the mounting slot is generally parallel to the male terminal insertion slot.

15. An electrical connector as in claim 14 wherein the mounting slot is isolated from the male terminal insertion slot by a portion of the housing.

16. An electrical connector as in claim 13 wherein the male terminal contact sections are located at distal ends of the arm and are generally parallel to the axial center line of the insertion slot.

17. An electrical connector as in claim 13 wherein the female terminal further comprises a solder tail extending from the base coaxial with a receiving area between the male terminal contact sections.

18. An electrical connector comprising:

a housing comprising at least one male terminal insertion slot, a female terminal mounting tongue slot in a first wall portion of the housing, the tongue slot being substantially parallel to the insertion slot, and at least two guide grooves substantially parallel to a centerline axis of the insertion slot and extending into two other side wall portions of the housing from the insertion slot on opposite sides of the insertion slot;

at least one female terminal connected to the housing, the female terminal comprising a base section, two arm sections extending at an inclination from the base section, male terminal contact sections on the arm sections, and a mounting tongue extending from the base section;

wherein the mounting tongue is located in the mounting slot, wherein the contact sections are movably located in the guide grooves, and wherein the mounting tongue and the arm sections extend, at least partially, a same length in a first direction from the base section.

* * * * *